US010515531B1

(12) United States Patent
Wang

(10) Patent No.: US 10,515,531 B1
(45) Date of Patent: Dec. 24, 2019

(54) BIDIRECTIONAL PROXIMITY ANNOUNCER

(71) Applicant: James Wang, Bakersfield, CA (US)

(72) Inventor: James Wang, Bakersfield, CA (US)

( * ) Notice: Subject to any disclaimer, the term of this patent is extended or adjusted under 35 U.S.C. 154(b) by 23 days.

(21) Appl. No.: 16/198,155

(22) Filed: Nov. 21, 2018

(51) Int. Cl.
*G08B 3/10* (2006.01)
*G08B 21/18* (2006.01)

(52) U.S. Cl.
CPC ..... *G08B 21/18* (2013.01); *G08B 3/10* (2013.01)

(58) Field of Classification Search
CPC ..... G08B 21/18; G08B 3/10
See application file for complete search history.

(56) References Cited

U.S. PATENT DOCUMENTS 5,721,532 A * 2/1998 Lehmann ..... G08B 13/1436 340/309.7
6,150,947 A * 11/2000 Shima ..... A63H 5/00 340/692
7,705,724 B2 * 4/2010 Cochran ..... G01W 1/04 340/517
8,031,074 B2 * 10/2011 Lizza ..... G08B 21/0415 340/3.1
9,311,793 B2 * 4/2016 Lohbihler ..... G08B 13/184
9,355,556 B2 * 5/2016 Schockmel ..... G07C 9/00111
2016/0240052 A1 * 8/2016 Hyde ..... G08B 7/066
2017/0088045 A1 * 3/2017 Bezzina ..... B60Q 5/005
2017/0352351 A1 * 12/2017 Kimura ..... A63H 5/00

OTHER PUBLICATIONS

APR33A3-APLUS intergrated Circuits Inc. Datasheet_Recording voice IC_Published Nov. 26, 2013.
2 BasicATOM Nano 18-Basic Micro Technology at Work Datasheet_ Published_2009.

* cited by examiner

*Primary Examiner* — Nay Tun
(74) *Attorney, Agent, or Firm* — Clement Cheng

(57) ABSTRACT

A bidirectional proximity announcer has a first proximity sensor configured to sense human movement in a first area. The first proximity sensor is a passive infrared sensor. A second proximity sensor is configured to sense human movement in a second area. The second proximity sensor is spaced apart laterally from the first proximity sensor. The first proximity sensor is mounted to the right or left of the second proximity sensor. The second proximity sensor is a passive infrared sensor. A sound processor integrated circuit provides a recording and playback of a first sound recording and a second sound recording. The sound processor integrated circuit is configured to record and play both the first sound recording and the second sound recording. The sound processor integrated circuit is configured to play sounds.

14 Claims, 5 Drawing Sheets

BIDIRECTIONAL PROXIMITY ANNOUNCER

FIELD OF THE INVENTION

The present invention is in the field of proximity announcers.

DISCUSSION OF RELATED ART

A variety of different motion sensitive reminder devices have been described in the prior art such as in Lehmann U.S. Pat. No. 5,721,532 issued Feb. 24, 1998, the disclosure of which is incorporated herein by reference, which describes, "A compact motion sensitive reminder device that is readily attachable to almost any movable item that emits an audio signal when the item is initially moved from a stationary condition and then remains silent during the item's use, and emits the audio signal again only after a certain amount of time that the movable item has remained stationary."

Digital voice recorders have also been customizable such as described by Welling in U.S. Pat. No. 5,810,420 issued Sep. 22, 1998, the disclosure of which is incorporated herein by reference, which describes in the abstract, "a digital voice recorder is conveniently located within a vehicle body by a basal position for convenient use by the vehicle operator. Preferably the body is a visor and the bezel is elongated with a record switch and a playback switch in spaced relationship for easy operation. The digital voice recorder is microprocessor controlled to allow direct sequential access for playing back messages."

Thus, the prior art describes a variety of different digital voice recorders having button or motion sensitive capabilities. U.S. Pat. No. 4,833,454 to Pawlik issued May 23, 1989, the disclosure of which is incorporated herein by reference, describes a Door Chime as described in the abstract as, "an audio signal devised for a door mounted advertising display, the display includes a signal unit, a battery connected to said signal unit, the unit including a tone generator, a pulse generator connected to control the tone generator, a timer connected to control the time of operation of the pulse generator, and a motion switch connected to energize the timer in response to the motion of the door, the timer further including a circuit for reactivation of the timer for a predetermined period of time." Thus, Pawlik uses a switch to activate a recording.

SUMMARY OF THE INVENTION

A bidirectional proximity announcer has a first proximity sensor configured to sense human movement in a first area. The first proximity sensor is a passive infrared sensor. A second proximity sensor is configured to sense human movement in a second area. The second proximity sensor is spaced apart laterally from the first proximity sensor. The first proximity sensor is mounted to the right or left of the second proximity sensor. The second proximity sensor is a passive infrared sensor. A sound processor integrated circuit provides a recording and playback of a first sound recording and a second sound recording. The sound processor integrated circuit is configured to record and play both the first sound recording and the second sound recording. The sound processor integrated circuit is configured to play sounds in a play sounds mode and record sounds in a record sounds mode. A microphone is connected to the sound processor integrated circuit. The microphone is configured to record the first sound recording and record the second sound recording for the sound processor integrated circuit. A programmable integrated circuit receives first proximity sensor data from the first proximity sensor, and receiving second proximity sensor data from the second proximity sensor.

The programmable integrated circuit is configured to command the sound processor integrated circuit to playback the first sound recording when the first proximity sensor is triggered first, followed by the second proximity sensor within a first delay time. The programmable integrated circuit is configured to command the sound processor integrated circuit to playback the second sound recording when the second proximity sensor is triggered first, followed by the first proximity sensor a second delay time. The first delay time and the second delay time are less than or equal to than five seconds.

The first delay time and the second delay time are equivalent and less or equal to than five seconds. The amplifier integrated circuit powers a speaker and receives a sound signal from the sound processor integrated circuit. The line in jack wired in parallel to the microphone. The first proximity sensor and the second proximity sensor are both digital pyroelectric sensors.

The sound processor integrated circuit has a record input mode set by a first general purpose I/O pin. The record input mode is activated when the first general purpose I/O pin is set to ground, wherein the sound processor integrated circuit records sounds in record input mode. The sound processor integrated circuit has a play mode set by a second general purpose I/O pin. The play mode is activated when the second general purpose I/O pin is set to ground. The sound processor integrated circuit plays back sounds in play mode. The sound processor integrated circuit has an active mode set by a third general purpose I/O pin. The active mode is activated when the third general purpose I/O pin is set to ground. The bidirectional proximity announcer waits for sensing human movement when in active mode.

Figure 1:
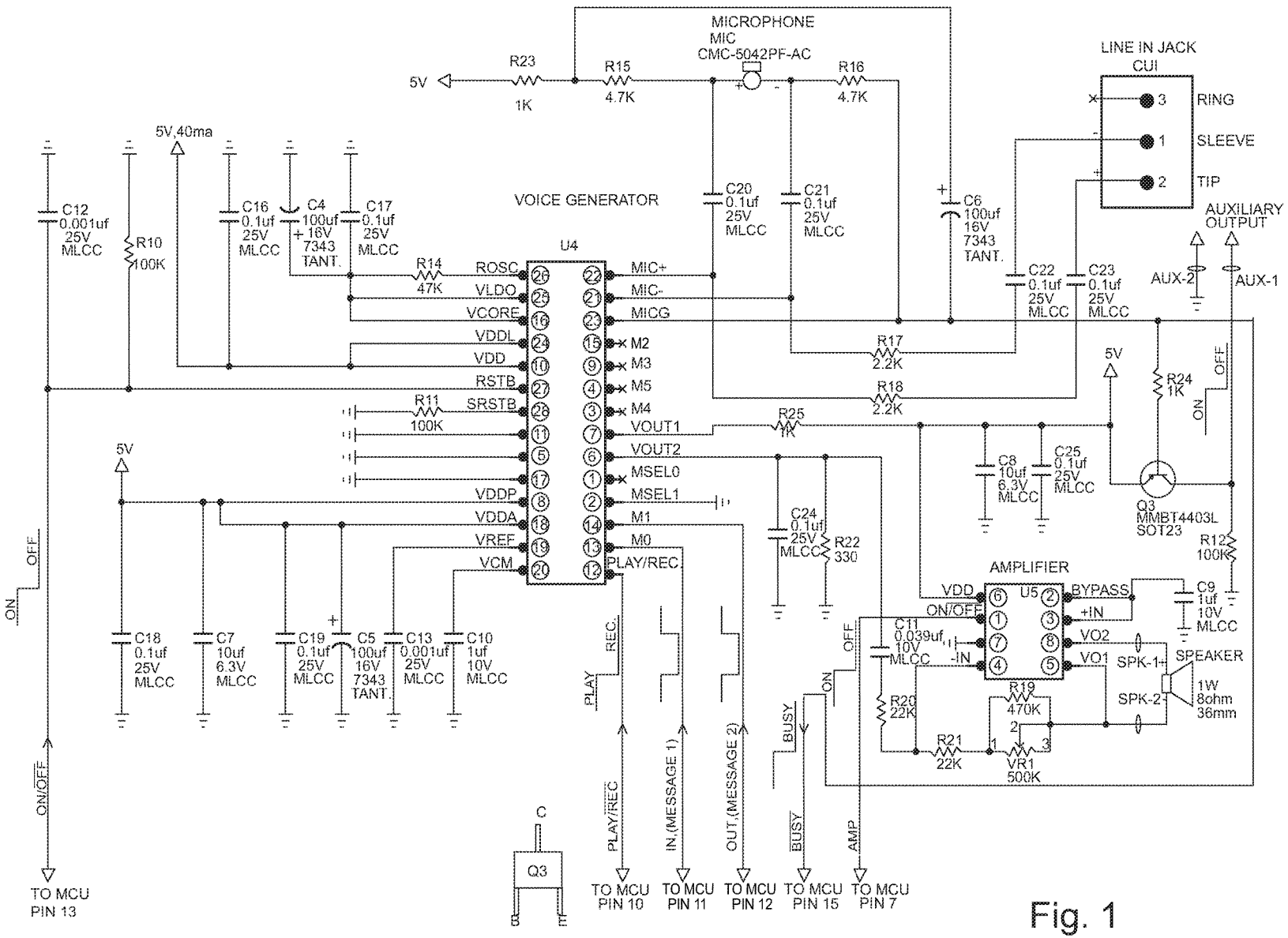
FIG. 1 is a circuit diagram showing the connection for the voice generator sound processor and amplifier chips.

The following call out list of elements can be a useful guide in referencing the element numbers of the drawings.

21 volume control
22 speaker plug
23 audio input jack
24 play record message one button
25 function switch
26 power switch
27 play record message two button
28 auxiliary jack output
29 outward sensor
30 battery plug
31 DC input jack 5V
32 LED power status button
33 microphone

34 inward sensor
35 speaker
41 outward sensor opening
42 inward sensor opening
43 LED power light opening
44 microphone opening
45 speaker opening
46 housing
51 power on
52 body passing in front of device
53 activation of sensor one or sensor two
54 activation of sensor two
55 activation of sensor one
56 waiting for sensor one
57 waiting for sensor two
58 timeout delay for sensor one
59 timeout delay for sensor two
60 clear reset of sensor one and two
61 clear reset of sensor one and two
62 sensor one check
63 sensor two check
64 sensors clear check
65 sensors clear check
66 play message two
67 play message one
MSEL0 message select
MSEL1 message select ground (message selection of the number of sounds being activated)
M0 message zero input from the MCU trigger message 0
M1 message 1 input from the MCU trigger message 1
M2 message 2 input from the MCU trigger message 2
M3 message 3 input from the MCU trigger message 3
M4 message 4 input from the MCU trigger message 4
M5 message 5 input from the MCU trigger message 5
M6/MSEL0 message 6, message select 0 input from the MCU trigger message 6
M7/MDEL1 message 7, message select 1 input from the MCU trigger message 7
Vout1 positive voice voltage which is an analog signal
Vout2 negative voice voltage which is also an analog signal
Mic+ positive microphone input
Mic− negative microphone input
MicG microphone ground, creates a virtual ground with 0V reference, has a reference voltage for the microphone
PLAY/REC play/record buttom
AUX 1 auxillary 1
AUX 2 auxillary 2
CUI Line in Jack
C1 Capacitor 1
C2 Capacitor 2
C3 Capacitor 3
C4 Capacitor 4
C5 Capacitor 5
C6 Capacitor 6
C7 Capacitor 7
C8 Capacitor 8
C9 Capacitor 9
C10 Capacitor 10
C11 Capacitor 11
C12 Capacitor 12
C13 Capacitor 13
C14 Capacitor 14
C15 Capacitor 15
C16 Capacitor 16
C17 Capacitor 17
C18 Capacitor 18
C19 Capacitor 19
C20 Capacitor 20
C21 Capacitor 21
C22 Capacitor 22
C23 Capacitor 23
C24 Capacitor 24
C25 Capacitor 25
C26 Capacitor 26
ROSC Oscillator resistor input
VLDO Internal LDO output
VCORE Positive power supply for core
VDD Positive power supply
RSTB Reset. (Low active)
SRSTB System reset, pull-down a resistor to the VSSL
VREF Reference voltage
VCM Common mode voltage
R10 resistor 10
R11 resistor 11
R14 resistor 14
R15 resistor 15
R16 resistor 16
R17 resistor 17
R18 resistor 18
R19 resistor 19
R20 resistor 20
R21 resistor 21
R22 resistor 22
R23 resistor 23
R24 resistor 24
R25 resistor 25
Q3 transistor 3
+IN positive input
Vo2 positive output
Vo1 negative output
R1 resistor 1
R2 resistor 2
R3 resistor 3
R4 resistor 4
R5 resistor 5
R6 resistor 6
R7 resistor 7
R8 resistor 8
R9 resistor 9
R13 resistor 13
R26 resistor 26
R27 resistor 27
Q1 transistor 1
Q2 transistor 2
SER programming pin. Bidirectional I/O
RES active-low reset. Pin is pulled high with 10 k pull up to run
P0 first general purpose I/O pin, for externally interrupt pin, PWM output, capture, compare input
P1 general purpose I/O pin, for SPI data in, 12C data
P2 general purpose I/O pin, for SPI data out, AUSART asynchronous receive, AUSART synchronous detect
P3 general purpose I/O pin, for PWM output, capture input, hardware PWM output
P4 general purpose I/O pin, for individually controlled interrupt-on-change, synchronous serial clock I/O for SPI, synchronous serial clock input for 12C
P5 general purpose I/O pin, for individually controlled interrupt-on-change, slave select for SPI in slave mode, ASUSART asynchronous transmit, AUSART synchronous clock
P6 general purpose I/O pin, for individually controlled interrupt-on-change, A/D channel 5

P7 general purpose I/O pin, for individually controlled interrupt-on-change, A/D channel 6
P8 general purpose I/O pin, A/D channel 0
P9 general purpose I/O pin, A/D channel 1
P10 general purpose I/O pin, A/D channel 2
P11 general purpose I/O pin, A/D channel 3
P12 general purpose I/O pin
P13 general purpose I/O pin
LED1 light emitting diode 1
SW2 switch 2
BAT1 battery 1
BAT2 battery 2
SW1 switch 1
D1 diode 1
U1 programmable integrated circuit
U2 regulator 5V circuit
U3 regulator 3V circuit
U4 sound processor integrated circuit
U5 amplifier integrated circuit

DETAILED DESCRIPTION OF THE PREFERRED EMBODIMENT

Glossary

MLCC stands for multi layer ceramic capacitor
TANT stands for tantalum electrolytic capacitor and can have a case size such as a case size of 7 3 4 3
MCU stands for microcontroller unit
Numbers in circles are pin numbers which are not necessarily arranged in order of physical location.
VREF stands for reference voltage
VDDL stands for drain to drain voltage logic(digital) side and sometimes=VDDD.
VDDP stands for drain to drain voltage processor
VDDA stands for drain to drain voltage analog side
VDD stands for drain to drain voltage
VCM stands for voltage common mode. Common-mode signals are identical signal components on both the + and − inputs of a differential amplifier or instrumentation amplifier.
Vcc refers to the positive supply voltage of a bipolar junction transistor
Vee refers to the negative supply voltage of a bipolar junction transistor
Vss refers to the negative supply voltage of a field effect transistor
The letters c, d, e and s refer to the legs of the transistors which are namely the Collector, Drain, Emitter and Source.

The present invention includes a power switch for turning off and turning on the device. It also has a function switch to select between different modes such as record mode, play mode and active mode. In a recording mode, pressing one of the play or record pushbuttons will allow the user to record sounds. In the play mode, pressing one of the play or record push buttons will allow the user to play a recorded sound. In the active mode, the device is ready to use and when a person passes across the sensors, a recorded message will play according to the direction in which the person passes. A first recorded sound can play when a person passes in a first direction and a second recorded sound can play when a person passes in a second direction. The play record pushbuttons are preferably formed as a pushbutton that allows a user to record or play message according to a function switch setting.

The sensors are preferably passive infrared sensors that detect a human presence so that when a person walks into a building, the device can say "hello" and when a person leaves the building the device can say "goodbye". The volume adjusts by a potentiometer for lowering or increasing the volume of a speaker. The microphone allows a user to speak to record messages to a sound chip.

The power on indicator is preferably an LED. The power jack optionally uses 5V power adapter to power the unit. A line in jack allows the user to download sounds to the sound chip from other electronic sound devices such as a computer, phone or MP3 player. A battery plug can allow for 9 V battery connection and battery-powered operation. A speaker plug provides a jack for speaker output connection. An auxiliary plug can provide active high output when a sound is playing. A user can connect this to operate and external device such as a relay, lamp, horn or other electronic device.

The present invention is implemented as seen in FIG. 1 with capacitors such as capacitor 4 C4 to capacitor 25 C25, resistor 10 R10 to resistor 25 R25, and transistor 3 Q3. The sound processor integrated circuit U4 provides voice capability for recording and playback of voices. The sound processor integrated circuit U4 provides the capability for selecting recordings of voices and a connection to a line in jack CUI for audio input. A variety of messages can be provided on message inputs such as: message zero input M0 from the MCU for triggering message 0; M1 message 1 input from the MCU for triggering message 1; message 2 input M2 from the MCU for triggering message 2; message 3 input M3 from the MCU for triggering message 3; message 4 input M4 from the MCU for triggering message 4; message 5 input M5 from the MCU for triggering message 5. Also, the integrated circuit can provide message 6 message select 0 M6/MSEL0 4 input from the MCU for triggering message 6 and also message 7 message select 1 M7/MDEL1 input from the MCU trigger for triggering message 7. Thus, a total of seven messages can be recorded and played back. The play/record button PLAY/REC allows a physical button control for controlling the integrated circuit to provide a sound recording record and playback control.

A variety of other connections implements the playback and record system including a microphone input including a positive microphone input Mic+, a negative microphone input Mic−, and a microphone ground MicG. The microphone input is controlled by the play/record button PLAY/REC. The sound processor integrated circuit U4 and the amplifier U5 can be implemented as integrated circuits.

Figure 2:
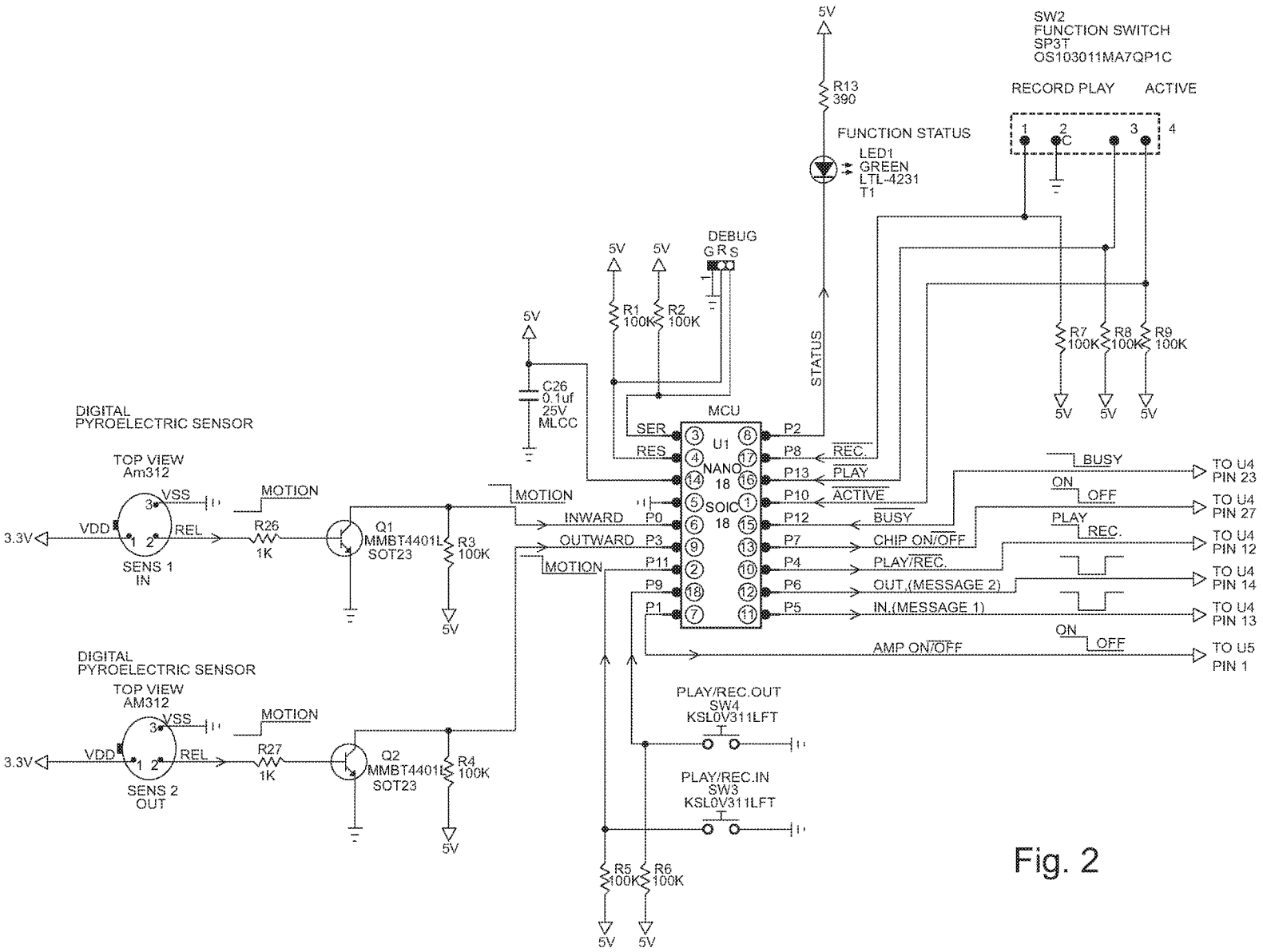
FIG. 2 is a circuit diagram showing the connections for the MCU.

As seen in FIG. 2, the present invention includes a circuit for implementing the programming of the programmable microcontroller U1. The programmable microcontroller can be an integrated circuit. The integrated circuit can have a variety of pins including pins such as: the bidirectional I/O programming pin SER; the active-low reset pin RES, which is pulled high with 10 k pull up to run; the first general purpose I/O pin P0 which is an external interrupt pin, for PWM output, capture, and comparing input; a second general purpose I/O pin P1, which is for SPI data in and 12C data; a third general purpose I/O pin P2 which is for SPI data out, AUSART asynchronous receive, and AUSART synchronous detect; a fourth general purpose I/O pin P3, PWM output, capture input, hardware PWM output; a fifth general purpose I/O pin P4 for individually controlled interrupt-on-change, synchronous serial clock I/O for SPI, synchronous serial clock input for 12C; a sixth general purpose I/O pin P5, individually controlled interrupt-on-change, slave select for SPI in slave mode, ASUSART asynchronous transmit, AUSART synchronous clock; a seventh general purpose I/O pin P6, for individually controlled interrupt-on-change, A/D channel 5; and an eighth a general purpose I/O pin P7, for individually controlled interrupt-on-change, A/D channel 6. The integrated circuit can also optionally include: a ninth general purpose I/O pin P8, for A/D channel 0; a tenth general purpose I/O pin P9 for enabling A/D channel 1; an eleventh general purpose I/O pin P10 for enabling A/D channel 2; a twelfth general purpose I/O pin P11 for enabling A/D channel 3; a thirteenth general purpose I/O pin P12; and a fourteenth general purpose I/O pin P13.

The programmable microcontroller U1 can be mounted on a circuit board with a variety of different components such as: transistor 1 Q1, transistor 2 Q2, resistor 1 R1, resistor 2 R2, resistor 3 R3, resistor 4 R4, resistor 5 R5, resistor 6 R6, resistor 7 R7, resistor 8 R8, resistor 9 R9, resistor 13 R1, resistor 26 R26, resistor 27 R27, capacitor 26 C26, light emitting diode 1 LED1, switch 2 SW2, switch 3 SW3, and switch 4 SW4.

Figure 7:
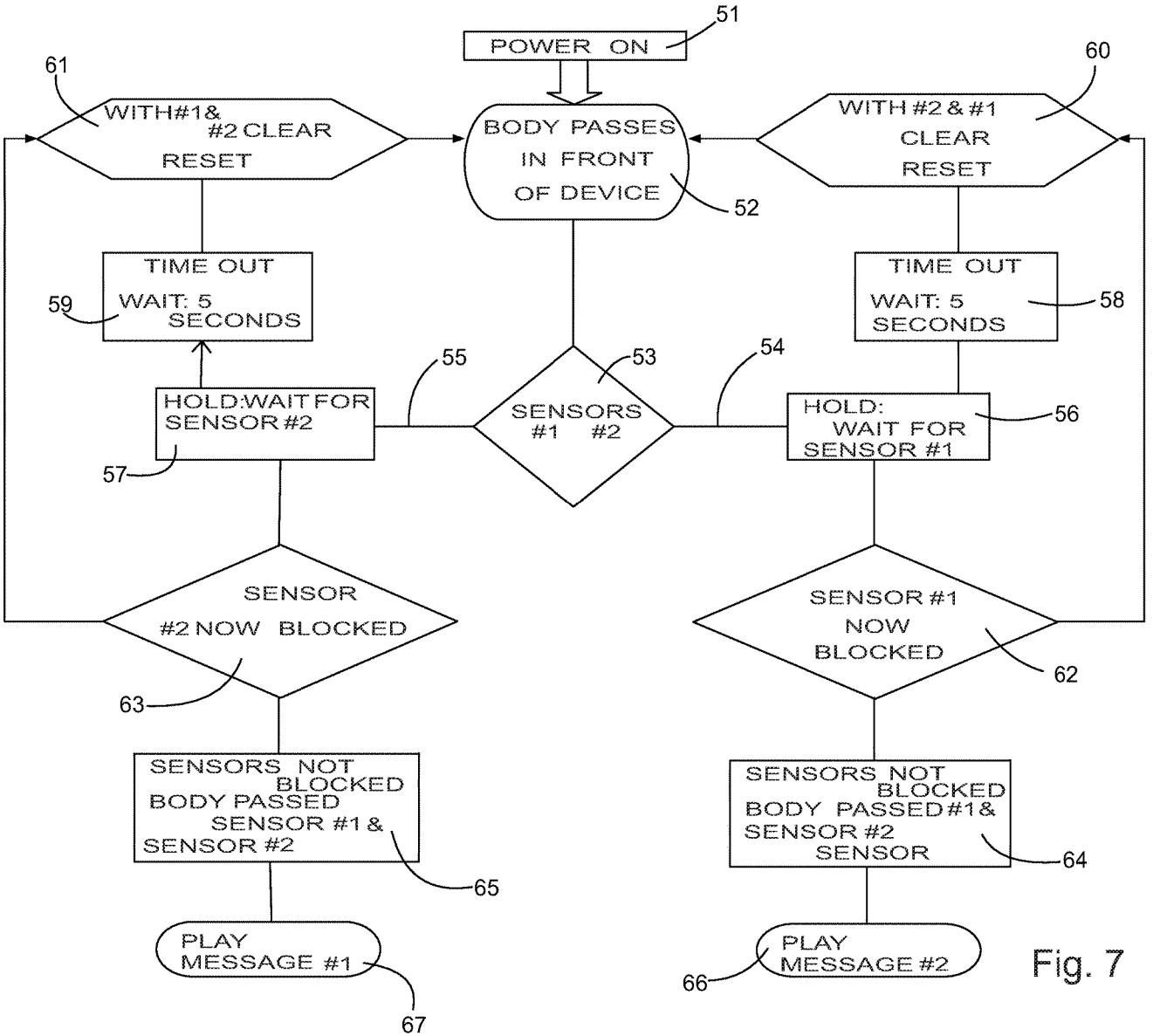
FIG. 7 is a logical diagram of the configuration of the bidirectional proximity announcer.

The programmable microcontroller U1 can provide programmable logic such as shown in FIG. 7, which is a flowchart of a variety of different steps and logical sequences. The first step is the power on 51 step. The programmable microcontroller then waits for the sensor to be triggered which is the body passing in front of device 52 step. Then the programmable microcontroller waits for activation of sensor one or sensor two 53. Due to the high clock cycle, most likely one of the sensors will be activated first as simultaneous activation is almost impossible. The programmable microcontroller waits for activation of sensor two 54 or activation of sensor one 55. After activation of sensor two 54, the microcontroller processes the step of waiting for sensor one 56. After activation of sensor one, the microcontroller processes the step of waiting for sensor two 57. After the step of waiting for sensor one 56, the microcontroller processes a timeout delay for sensor one 58 such as in the amount of 5 seconds if the other sensor is not triggered by then at which point, the clear reset of sensor one and two 60 will occur. If the other sensor is triggered, the microcontroller sets a state of the sensor one check 62 and then sets a state for sensors clear check 64 which leads to the play message two 66 step.

Similarly, the activation of the first sensor will lead to either a timeout delay for sensor two 59 which will lead to a clear reset of sensor one and two 61 or else a sensor two check 63 will return a positive result so that the microcontroller then sets a state of the sensor two check 63 and then sets a sensors clear check 65 before activating the command to play message one 67. The microcontroller sends the command to play message one 67 or the command to play message two 66 step back to the sound processor integrated circuit U4.

Figure 3:
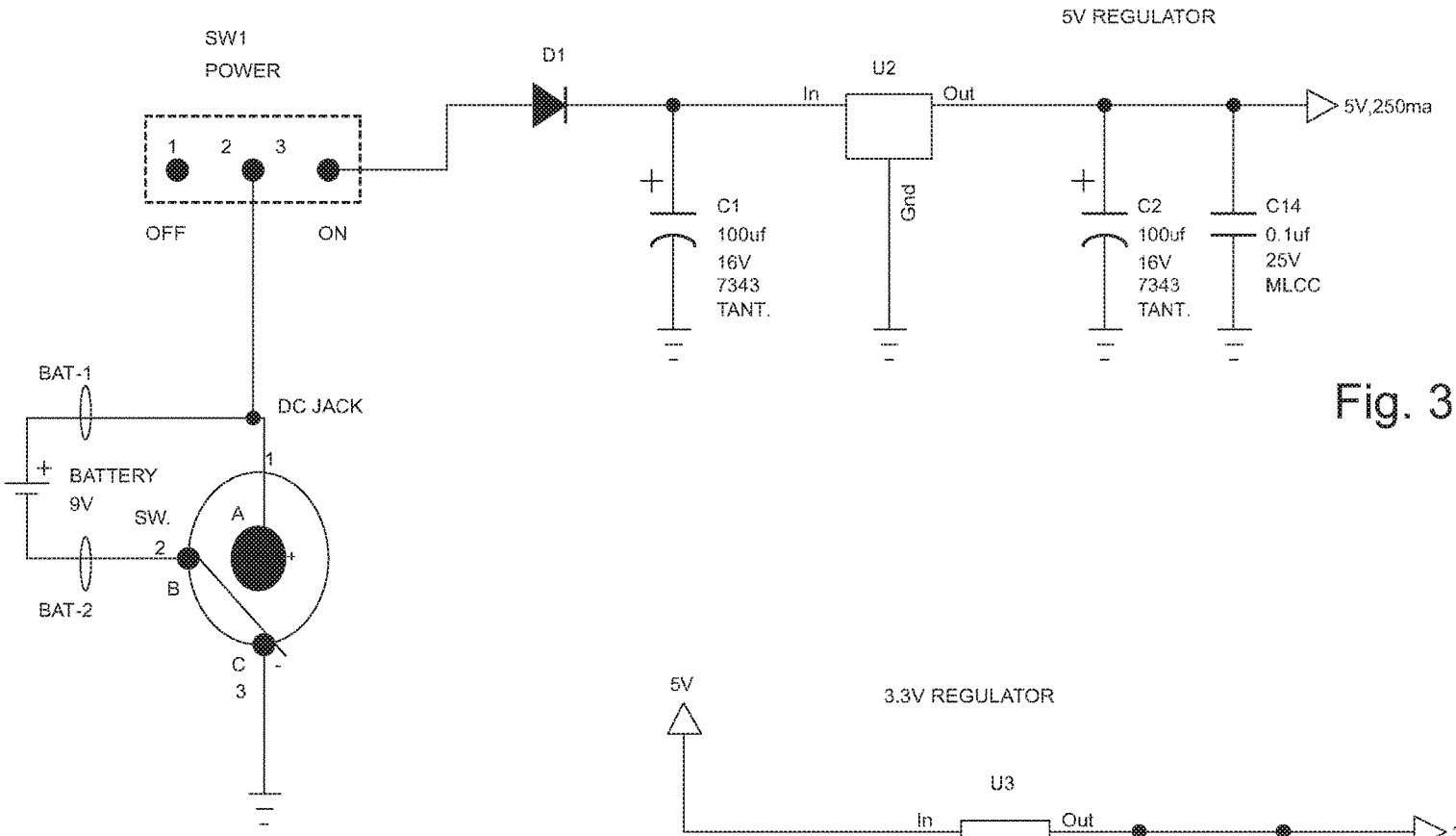
FIG. 3 is a circuit diagram showing the configuration for providing 5V power.
Figure 4:
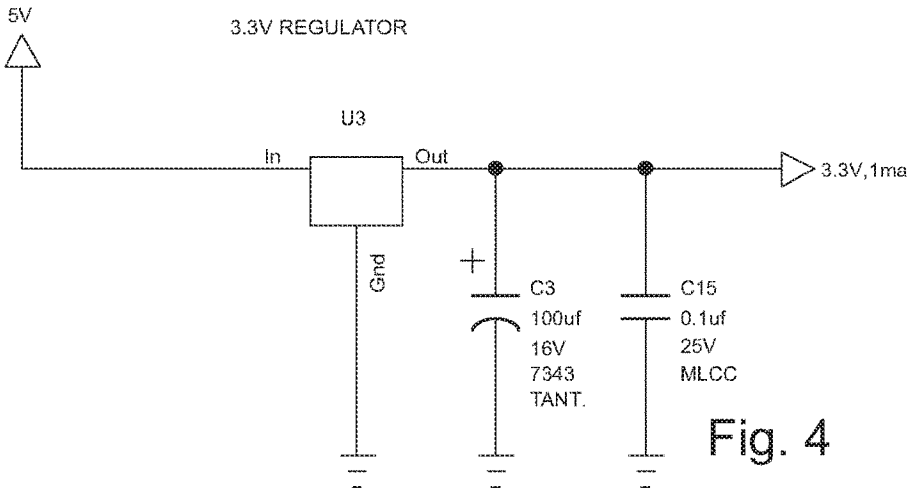
FIG. 4 is a circuit diagram showing the configuration for providing 3.3 V power taken from the 5V side.

FIGS. 3 and 4 shows the power configuration for the device which include: a battery 1 BAT1 and battery 2 BAT2 4 providing power; a switch 1 SW1; and a diode 1 D1. The device can be implemented on a circuit board that includes capacitor 1 C1; capacitor 2 C2; capacitor 3 C3; capacitor 14 C14; and capacitor 15 C15. The regulator 5V circuit U2 provides a power regulation feature. As seen in FIG. 4, the regulator 3V circuit U3 provides a power regulation feature. Generally, the programmable integrated circuit U1 controls the sound processor integrated circuit U4 and both are powered by an amplifier circuit. For example, the inward motion of a human walking across the field of view of the bidirectional proximity announcer can be received on the first general purpose I/O pin P0 which can be pin number 6 as seen on FIG. 2. A different pin can receive motion in an outward direction so that a salutation such as "goodbye" can be played when motion in the outward direction is detected. Detecting motion in the inward direction provides a salutation such as "hello". Waiting for each sensor to activate individually in sequence within a predetermined amount of time is the best mode for implementing directional detection. Because the device is placed laterally with a first sensor on the right side and a second sensor on the left side, then the first sensor on the right side will be capturing a field of view in the more rightward area and the second sensor on the left side would be capturing a field of view in the more leftward area. The rightward area can be the inward area that is more inside of the building, and the leftward area can be the outward area that is more outside of the building. By arranging the device to monitor human movement, the pair of motion sensors can sense human movement and accordingly play the appropriate message.

Figure 6:
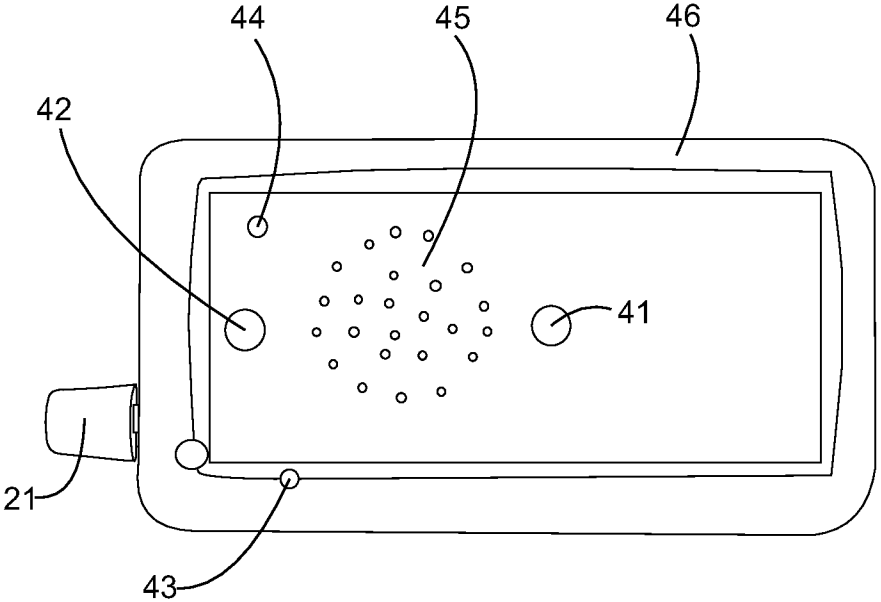
FIG. 6 is a side view of the housing.
Figure 5:
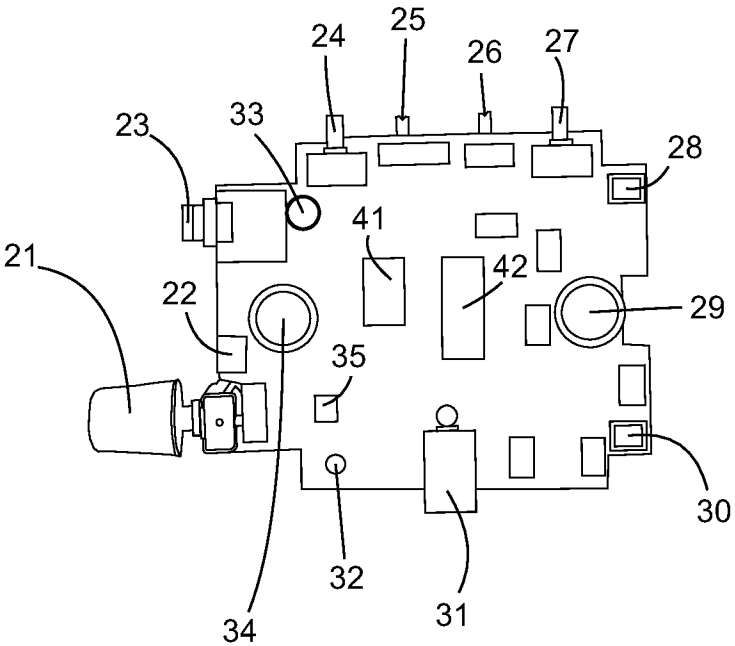
FIG. 5 is a side view of the physical circuit board having the electronics installed.

As seen in FIG. 6, the external view of the bidirectional proximity announcer includes a volume control 21 that can be implemented as a potentiometer dial, an outward sensor opening 41, inward sensor opening 42 spaced apart from the outward sensor opening, a microphone opening 44, a speaker opening 45 and a housing 46. The external housing holds the circuitry underneath which is seen in FIG. 5. The circuitry can include a volume control 21, a speaker plug 22, a audio input jack 23, play record message one button 24, a function switch 25, a power switch 26, a play record message two button 27, an auxiliary jack output 28, an outward sensor 29, a battery plug 30, a DC input jack 5V 31, a LED power status button 32, a microphone 33, an inward sensor 34, a speaker 35, an outward sensor aligned to the outward sensor opening 41 and an inward sensor aligned to the inward sensor opening 42. The sound processor integrated circuit U4 is a type of voice generator that can generate voices, messages for other prerecorded sounds.

The volume control 21 control the volume. The speaker plug 22 allows the speaker to be connected. The audio input jack 23 allows an external microphone to be connected for recording messages. The play record message one button 24 allows recording and playback of the first message. A function switch 25 selects between recording, playback and active mode where the bidirectional proximity announcer is waiting to be triggered for playing back messages. The power switch 26 allows the user to turn off and turn on the device. The play record message two button 27 allows recording and playback of the second message. An auxiliary jack output 28 allows playback to an external device. An outward sensor 29 works with the inward sensor 34 to form a sensor pair that when activated individually in sequence within a set amount of time provides for a playback of the message. The battery plug 30 allows for wireless operation. A DC input jack 5V 31 provides for battery free operation. The LED power status button 32 indicates power. The microphone 33 provides a sound input. A speaker 35 provides a sound output. Preferably, the outward sensor aligned and flush to the outward sensor opening 41 and preferably the inward sensor is aligned and flush to the inward sensor opening 42.

The invention claimed is:

1. A bidirectional proximity announcer comprising:

a first proximity sensor configured to sense human movement in a first area;

a second proximity sensor configured to sense human movement in a second area, wherein the second proximity sensor is spaced apart laterally from the first proximity sensor;

a sound processor integrated circuit providing a recording and playback of a first sound recording and a second sound recording, wherein the sound processor integrated circuit is configured to record and play both the first sound recording and the second sound recording, wherein the sound processor integrated circuit is configured to play sounds in a play sounds mode and record sounds in a record sounds mode;

a microphone connected to the sound processor integrated circuit, wherein the microphone is configured to record the first sound recording and record the second sound recording for the sound processor integrated circuit; and a programmable integrated circuit receiving first proximity sensor data from the first proximity sensor, and receiving second proximity sensor data from the second proximity sensor, wherein the programmable integrated circuit is configured to command the sound processor integrated circuit to playback the first sound recording when the first proximity sensor is triggered first, followed by the second proximity sensor within a first delay time, and wherein the programmable integrated circuit is configured to command the sound processor integrated circuit to playback the second sound recording when the second proximity sensor is triggered first, followed by the first proximity sensor a second delay time.

2. The bidirectional proximity announcer of claim 1, wherein the first delay time and the second delay time are less than or equal to five seconds.

3. The bidirectional proximity announcer of claim 1, further including an amplifier integrated circuit, wherein the amplifier integrated circuit powers a speaker and receives a sound signal from the sound processor integrated circuit.

4. The bidirectional proximity announcer of claim 1, further including a line in jack wired in parallel to the microphone.

5. The bidirectional proximity announcer of claim 1, wherein the first proximity sensor and the second proximity sensor are both passive infrared sensors.

6. The bidirectional proximity announcer of claim 1, wherein the first proximity sensor and the second proximity sensor are both digital pyroelectric sensors.

7. The bidirectional proximity announcer of claim 1, wherein the sound processor integrated circuit has a record input mode set by a first general purpose I/O pin, wherein the record input mode is activated when the first general purpose I/O pin is set to ground, wherein the sound processor integrated circuit records sounds in record input mode.

8. The bidirectional proximity announcer of claim 7, wherein the sound processor integrated circuit has a play mode set by a second general purpose I/O pin, wherein the play mode is activated when the second general purpose I/O pin is set to ground, wherein the sound processor integrated circuit plays back sounds in play mode.

9. The bidirectional proximity announcer of claim 8, wherein the sound processor integrated circuit has an active mode set by a third general purpose I/O pin, wherein the active mode is activated when the third general purpose I/O pin is set to ground, wherein the bidirectional proximity announcer waits for sensing human movement when in active mode.

10. A bidirectional proximity announcer comprising:

a first proximity sensor configured to sense human movement in a first area, wherein the first proximity sensor is a passive infrared sensor;

a second proximity sensor configured to sense human movement in a second area, wherein the second proximity sensor is spaced apart laterally from the first proximity sensor, wherein the first proximity sensor is mounted to the right or left of the second proximity sensor, wherein the second proximity sensor is a passive infrared sensor;

a sound processor integrated circuit providing a recording and playback of a first sound recording and a second sound recording, wherein the sound processor integrated circuit is configured to record and play both the first sound recording and the second sound recording, wherein the sound processor integrated circuit is configured to play sounds in a play sounds mode and record sounds in a record sounds mode;

a microphone connected to the sound processor integrated circuit, wherein the microphone is configured to record the first sound recording and record the second sound recording for the sound processor integrated circuit; and a programmable integrated circuit receiving first proximity sensor data from the first proximity sensor, and receiving second proximity sensor data from the second proximity sensor, wherein the programmable integrated circuit is configured to command the sound processor integrated circuit to playback the first sound recording when the first proximity sensor is triggered first, followed by the second proximity sensor within a first delay time, and wherein the programmable integrated circuit is configured to command the sound processor integrated circuit to playback the second sound recording when the second proximity sensor is triggered first, followed by the first proximity sensor a second delay time, wherein the first delay time and the second delay time are less than or equal to five seconds.

11. The bidirectional proximity announcer of claim 10, further including a line in jack wired in parallel to the microphone, further including an amplifier integrated circuit, wherein the amplifier integrated circuit powers a speaker and receives a sound signal from the sound processor integrated circuit.

12. The bidirectional proximity announcer of claim 10, wherein the sound processor integrated circuit has a record input mode set by a first general purpose I/O pin, wherein the record input mode is activated when the first general purpose I/O pin is set to ground, wherein the sound processor integrated circuit records sounds in record input mode, wherein the first proximity sensor and the second proximity sensor are both digital pyroelectric sensors.

13. The bidirectional proximity announcer of claim 12, wherein the sound processor integrated circuit has a play mode set by a second general purpose I/O pin, wherein the play mode is activated when the second general purpose I/O pin is set to ground, wherein the sound processor integrated circuit plays back sounds in play mode.

14. The bidirectional proximity announcer of claim 13, wherein the sound processor integrated circuit has an active mode set by a third general purpose I/O pin, wherein the active mode is activated when the third general purpose I/O pin is set to ground, wherein the bidirectional proximity announcer waits for sensing human movement when in active mode.

* * * * *